US010773870B2

(12) United States Patent
Ikeda

(10) Patent No.: US 10,773,870 B2
(45) Date of Patent: Sep. 15, 2020

(54) PACKAGE, CARTON AND BLANK THEREFOR

(71) Applicant: WestRock Packaging Systems, LLC, Atlanta, GA (US)

(72) Inventor: Tamio Ikeda, Kawasaki (JP)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 16/092,898

(22) PCT Filed: Apr. 17, 2017

(86) PCT No.: PCT/US2017/027894

§ 371 (c)(1),
(2) Date: Oct. 11, 2018

(87) PCT Pub. No.: WO2017/184493

PCT Pub. Date: Oct. 26, 2017

(65) Prior Publication Data

US 2019/0202615 A1 Jul. 4, 2019

Related U.S. Application Data

(60) Provisional application No. 62/324,569, filed on Apr. 19, 2016.

(51) Int. Cl.
*B65D 71/20* (2006.01)
*B65D 71/16* (2006.01)

(52) U.S. Cl.
CPC ..... *B65D 71/20* (2013.01); *B65D 71/16* (2013.01); *B65D 2571/0016* (2013.01); *B65D 2571/0066* (2013.01); *B65D 2571/00265* (2013.01); *B65D 2571/00277* (2013.01); *B65D 2571/00456* (2013.01); *B65D 2571/00716* (2013.01)

(58) Field of Classification Search
CPC ..... B65D 65/00; B65D 41/16; B65D 71/16
USPC ..... 206/434, 140, 429–431, 435, 427, 147, 206/152, 175, 148, 65
See application file for complete search history.

(56) References Cited

U.S. PATENT DOCUMENTS 2,986,271 A * 5/1961 Forrer ..... B65D 71/16 206/427
3,963,170 A * 6/1976 Wood ..... B65D 71/20 206/434
4,200,220 A * 4/1980 Ganz ..... B65D 71/18 206/140

(Continued)

FOREIGN PATENT DOCUMENTS

GB 2123385 * 2/1984 ..... B65D 71/120
GB 2123385 A 2/1984

(Continued)

*Primary Examiner* — J. Gregory Pickett
*Assistant Examiner* — Tia Cox
(74) *Attorney, Agent, or Firm* — WestRock Intellectual Property Group

(57) ABSTRACT

A package comprises a wraparound carrier (90) enclosing a plurality of articles (C) arranged in a two-row group. Each of the plurality of articles has a tapered body and a peripheral chime (70) defining a recessed bottom. The wraparound carrier includes a plurality of chime locks (58) that each engage the peripheral chime of a respective one of the plurality of articles.

7 Claims, 13 Drawing Sheets

(56) References Cited

U.S. PATENT DOCUMENTS

| | | | | | |
|---|---|---|---|---|---|
| 4,596,356 | A | * | 6/1986 | Chaussadas | B65D 71/16 206/486 |
| 4,702,847 | A | | 11/1987 | Oliff | |
| 4,703,847 | A | * | 11/1987 | Oliff | B65D 71/16 206/140 |
| 4,708,284 | A | * | 11/1987 | Sutherland | B65D 71/36 229/198.2 |
| 5,439,112 | A | | 8/1995 | De Guglilmo et al. | |
| 5,484,059 | A | * | 1/1996 | Sutherland | B65D 71/18 206/434 |
| 5,765,685 | A | * | 6/1998 | Roosa | B65D 71/16 206/140 |
| 5,957,289 | A | * | 9/1999 | Negelen | B65D 71/20 206/140 |
| 6,988,617 | B2 | * | 1/2006 | Gomes | B65D 71/14 206/434 |
| 8,056,709 | B2 | * | 11/2011 | Sutherland | B65D 71/46 206/147 |
| 9,211,986 | B2 | * | 12/2015 | Auclair | B65D 71/22 |

FOREIGN PATENT DOCUMENTS

| | | | |
|---|---|---|---|
| JP | 4505061 | B2 | 7/2010 |
| WO | WO2012037542 | A1 | 3/2012 |

* cited by examiner

PACKAGE, CARTON AND BLANK THEREFOR

TECHNICAL FIELD

The present invention relates to a carton, to a blank for forming the carton, and to a package comprising the carton and a number of articles contained therein, and more particularly to a carton having improved locking features for securely retaining articles having a peripheral rim or chime extending beyond at least one end thereof.

BACKGROUND

In the field of packaging it is often required to provide consumers with a package comprising multiple primary product containers. Such multi-packs are desirable for shipping and distribution and for display of promotional information. One common variety of multipack is the wraparound type in which a carrier blank is formed into a sleeve that wraps around a number of articles. One difficulty associated with wrap-around type carriers is ensuring that the articles are securely held in place by the carrier. It can be particularly difficult to securely hold multiple rows of articles and/or tapered articles with a wrap-around type carrier. Thus, it would be desirable to provide a wrap-around type carrier having improved locking features for securely retaining articles.

SUMMARY

According to a first aspect of the invention, there is provided a package including a plurality of articles and a wraparound carrier enclosing the plurality of articles. The plurality of articles are arranged in a two-row group. Each of the plurality of articles includes a tapered body and a peripheral chime defining a recessed bottom. The wraparound carrier includes a plurality of chime locks, each of the plurality of chime locks engaging the peripheral chime of a corresponding one of the plurality of articles.

Optionally, each of the plurality of chime locks includes a retaining aperture in which the peripheral chime of the corresponding one of the plurality of articles is received, and a retaining tab that sits within the recessed bottom of the corresponding one of the plurality of articles. The retaining aperture is formed in a side wall of the wraparound carrier when the retaining tab is folded out of plane with a remaining portion of the side wall.

Optionally, the retaining tab is hinged along an arcuate fold line extending between opposite ends of the retaining aperture.

Optionally, each of the plurality of articles further includes a flanged top, and the wraparound carrier further includes a plurality of flange engaging slots, each of the plurality of flange engaging slots engaging the flanged top of a corresponding one of the plurality of articles.

Optionally, a bottom wall of the wraparound carrier is formed from a bull-sized bottom panel.

Optionally, the wraparound carrier further includes a secondary bottom panel, wherein the full-sized bottom panel and the secondary bottom panel are secured together via a corner lock.

Optionally, the corner lock includes a male locking projection hingedly connected to the full-sized bottom panel and a female locking opening formed at or adjacent to a fold line between the secondary bottom panel and a first side panel of the wraparound carrier.

Optionally, a bottom wall of the wraparound carrier includes a pair of glued or corner-locked bottom lap panels.

According to a second aspect of the invention, there is provided a wraparound carrier for packaging a plurality of articles arranged in at least a one-row group. Each of the plurality of articles includes a substantially cylindrical body and a peripheral chime defining a recessed bottom. The wraparound carrier includes a plurality of chime locks, each of the chime locks including a retaining aperture for receiving part of the peripheral chime of a corresponding one of the plurality of articles and a retaining tab for placement within the recessed bottom of the corresponding one of the plurality of articles. The wraparound carrier further includes first and second corner-locked bottom lap panels.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "carton" and "carrier" refer, for the non-limiting purpose of illustrating the various features of the invention, to a container for engaging, carrying, and/or dispensing articles, such as cups, bowls, tins, cans and/or bottles having a peripheral rim of chime extending beyond at least one end thereof.

Figure 1:
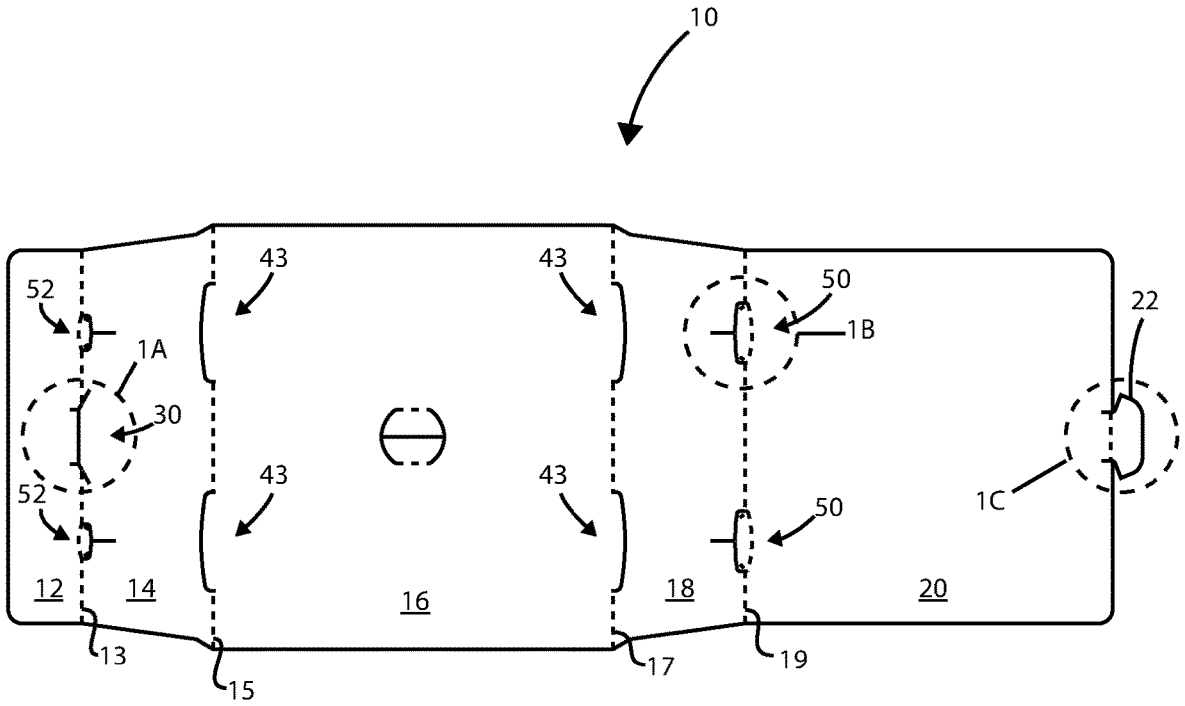
FIG. 1 is a plan view of a blank for forming a carton according to an embodiment of the invention.
Figure 2:
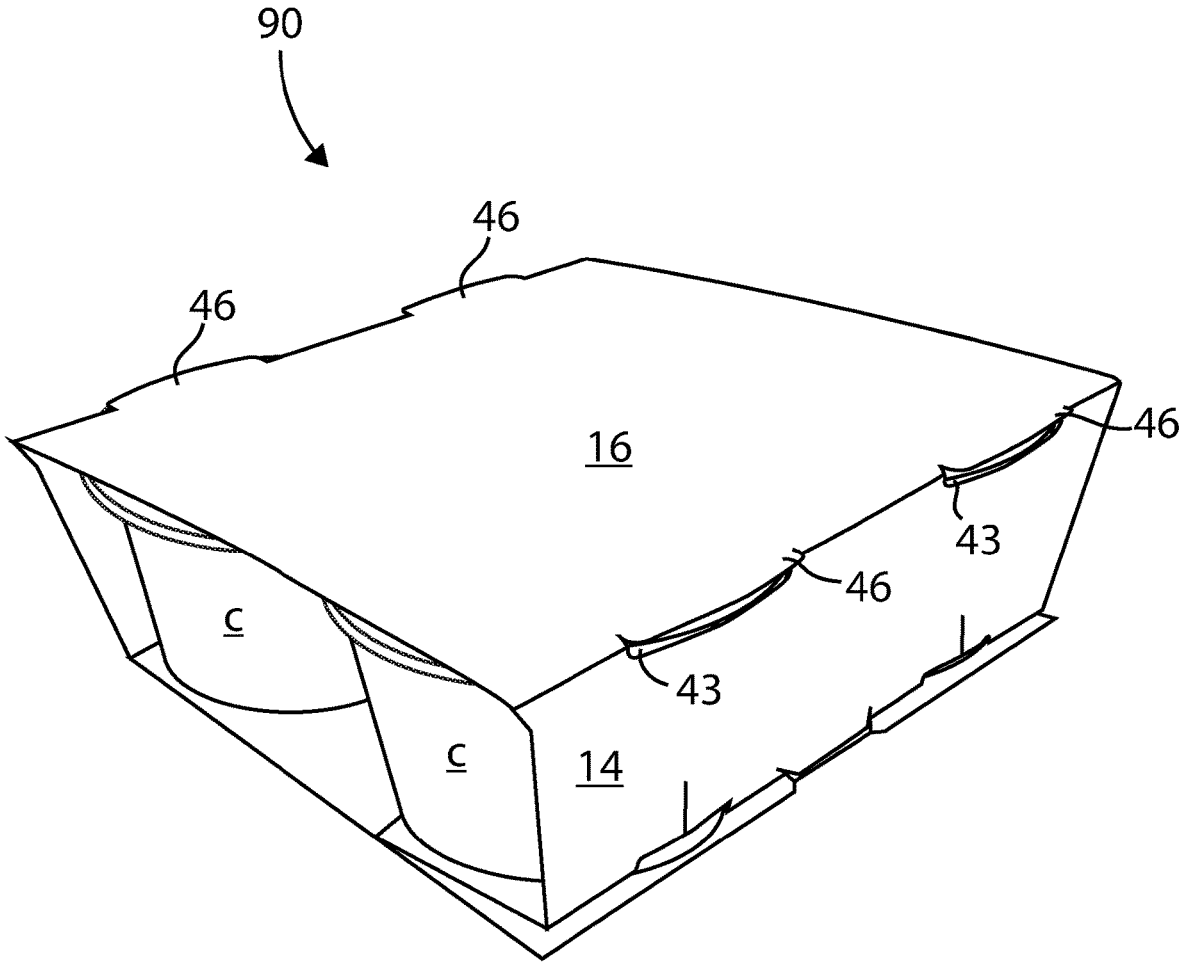
FIG. 2 is a perspective view of the carton formed from the blank of FIG. 1.

Referring to FIG. 1, there is shown a first blank 10 for forming a carrier 90 (see FIG. 2). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carton described in more detail below.

In the exemplary embodiment, the blank 10 is configured to form a carrier 90 for packaging an exemplary arrangement of exemplary articles C. In this example, the arrangement is a 2×2 matrix or array, and the articles C are tapered cups having a flanged top lid and recessed bottom. The blank 10 can be alternatively configured to form a carton for packaging other articles and/or different arrangements of articles and articles of different sizes.

Referring to FIG. 1, the blank 10 includes a plurality of main panels 12, 14, 16, 18, 20 hinged together in a linear series. In a set-up condition, the main panels form a tubular structure or sleeve that encloses a plurality of articles C. Blank 10 includes a secondary bottom panel 12, a first side panel 14, a top panel 16, a second side panel 18, and a primary bottom panel 20. Secondary bottom panel 12 is hingedly connected to first side panel via transverse fold line 13. First side panel 14 is hingedly connected to top panel 16 via transverse fold line 15. Top panel 16 is hingedly connected to second side panel 18 via transverse fold line 17. Second side panel is hingedly connected to primary bottom panel 20 via transverse fold line 19.

Figure 1A:
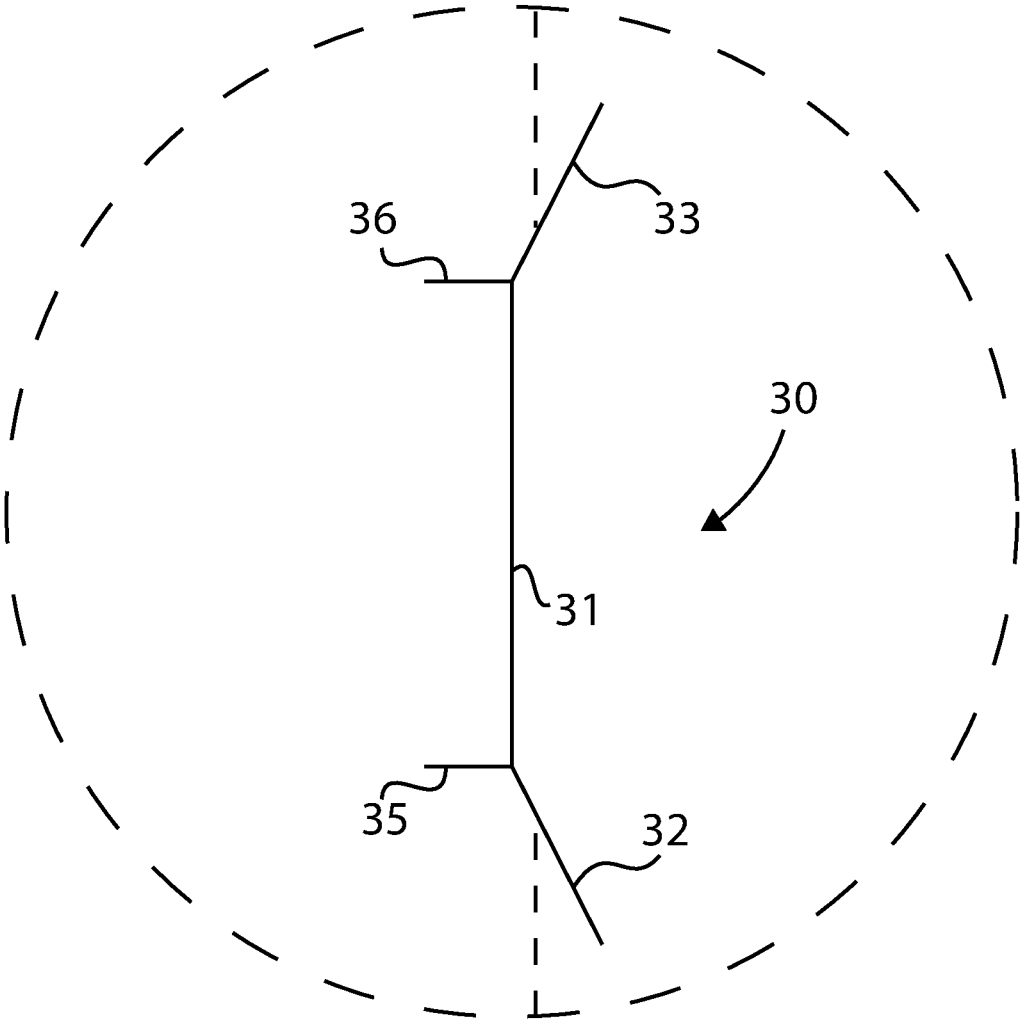
FIG. 1A is an enlarged view of the portion of the blank of FIG. 1 within the circular dash lines labelled 1A.

Blank 10 also includes a corner-locking arrangement consisting of a male locking projection 22 that is shaped for being received in a corresponding female locking opening 30. Female locking opening 30 (best seen in FIG. 1A) is formed from slits 31, 32, 33. In the illustrated embodiment, slit 31 is a straight-line cut that extends in a transverse direction across a portion of secondary bottom panel 12. Slit 31 is disposed closely adjacent to a transverse axis defined by fold line 13. Slits 32 and 33, which are shorter in length than slit 31, extend outwardly and obliquely from opposite ends of slit 31, interrupting fold line 13 and extending partially into first side panel 14. Two short, spaced apart slits 35, 36 extend longitudinally from slit 31 in the direction of secondary bottom panel 12. When secondary bottom panel 13 and first side panel 14 are folded out of plane with one another, slits 31, 32, 33 form female locking opening 30.

Male locking projection 22 (best seen in FIG. 1C) is shaped for being received in female locking opening 30 to lock carrier 90 in a sleeve configuration. Male locking projection 22 is foldably connected to primary bottom panel 20 via transverse fold line 21. In the illustrated embodiment, fold line 21 is generally coincident with an axis defined by the outermost edge of primary bottom panel 20. Two short, spaced-apart longitudinal slits 38, 39 extend from the outermost edge of primary bottom panel 20 towards its interior and define therebetween a narrow neck portion 40 of the locking projection. Male locking projection 22 has shoulders 41, 42 that extend laterally outward from narrow neck portion 40.

When carrier 90 is constructed, male locking projection 22 is inserted through the female locking opening 30. The shoulders 41, 42 of the male locking projection 22 engage portions of the carton adjacent to slits 32, 33 to prevent disengagement of the male locking projection 22 from the female locking opening 30.

Blank 10 includes four top flange engaging slots 43, each corresponding to one of the four articles C. Each of top flange engaging slots 43 is formed from a shallow generally U-shaped cut that includes a transversely-extending linear portion and rounded corner portions extending from respective ends thereof. Two of slots 43 are generally disposed between first side panel 14 and top panel 16 so as to interrupt fold line 15; and the other two slots 43 are generally disposed between second side panel 18 and top panel 16 so as to interrupt fold line 17. As shown in FIG. 2, a portion of each of the flanged lids of articles C extends through a respective slot 43 formed in the upper side panels 14, 18 just beneath the top panel 16. The portions of the top panel 16 adjacent to slots 43 form outwardly projecting tabs 46 that overlie the portions of the flanged lids that extend through slots 43.

Blank 10 also includes four bottom chime locks 50, 52, each of which corresponds to one of the four articles C. In the illustrated embodiment, two chime locks 50 are generally disposed between second side panel 18 and primary bottom panel 20 so as to interrupt fold line 19, and two chime locks 52 are generally disposed between secondary bottom panel 12 and first side panel 14 so as to interrupt fold line 13. Each of the chime locks 50, 52 has a generally identical configuration in the illustrated embodiment except that the proportions of chime locks 52 are smaller than those of chime locks 50.

Figure 1B:
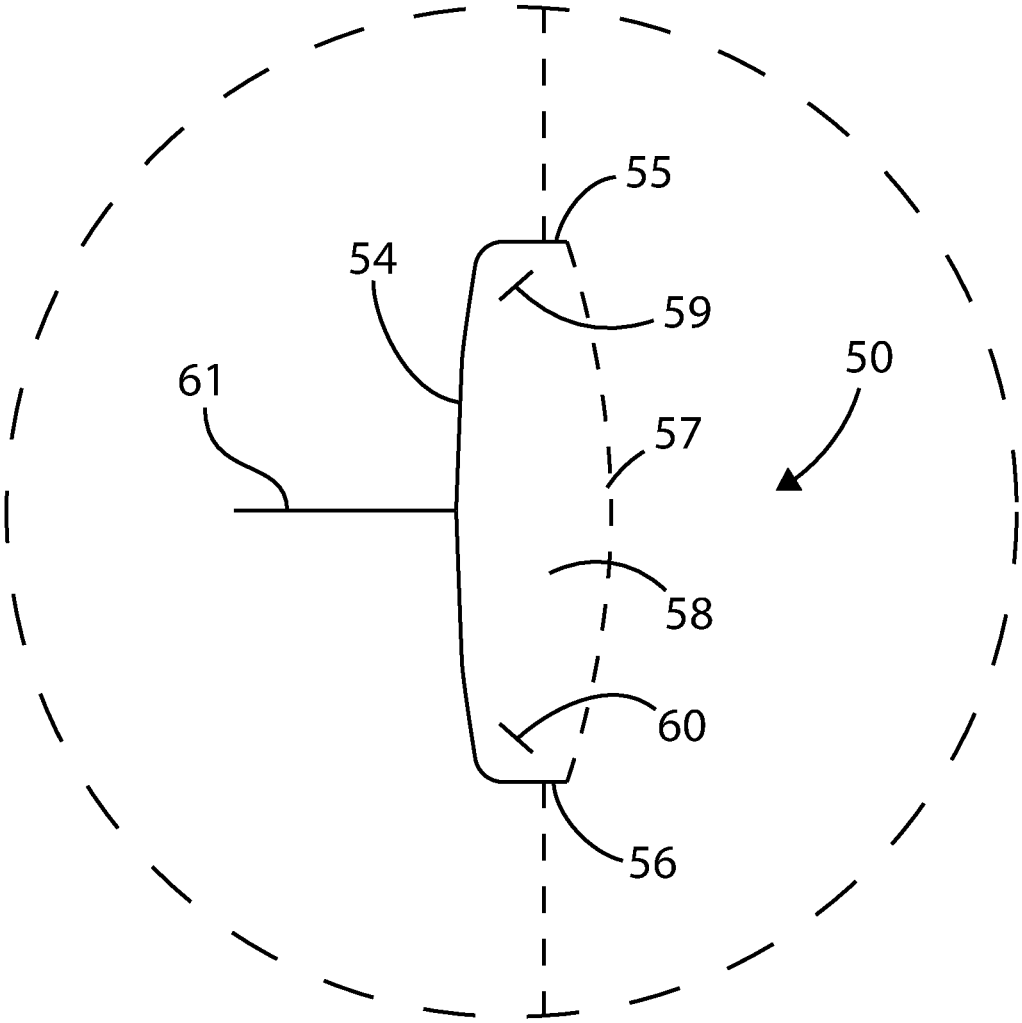
FIG. 1B is an enlarged view of the portion of the blank of FIG. 1 within the circular dash lines labelled 1B.
Figure 1C:
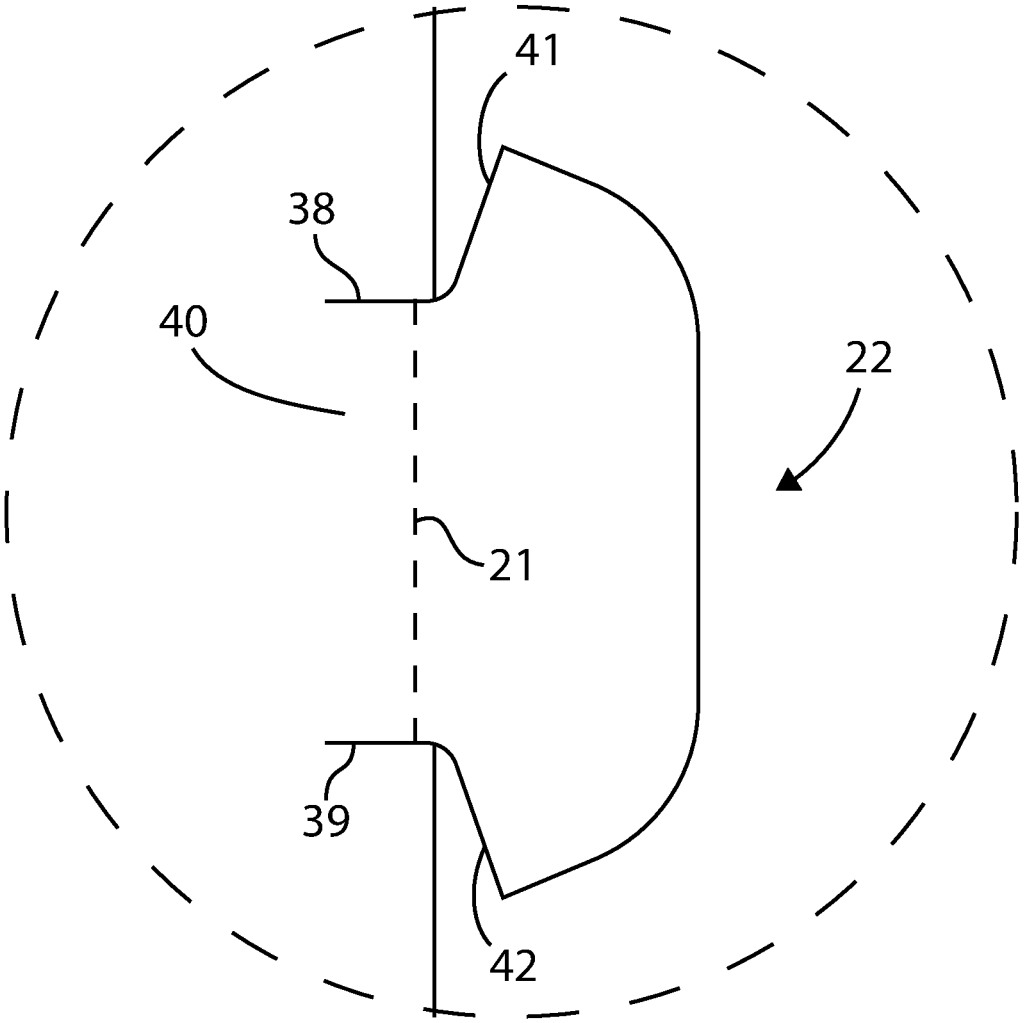
FIG. 1C is an enlarged view of the portion of the blank of FIG. 1 within the circular dash lines labelled 1C.

FIG. 1B shows a close-up view of the portion of blank 10 corresponding to chime lock 50. Chime lock 50 is defined by a shallow generally U-shaped cut that includes a transversely-extending linear portion 54 and rounded corner portions 55, 56 extending from respective ends thereof. An arcuate fold line 57 formed in primary bottom panel 20 extends from an outermost edge of rounded corner portion 55 to an outermost edge of rounded corner portion 56, and has its center of curvature at a location on second side wall 18 beyond linear portion 54. Arcuate fold line 57 together with linear portion 54 and rounded corner portions 55, 56 form a foldable chime retaining tab 58. Chime retaining tab 58 includes oblique fold lines 59, 60 respectively, one extending between each hinged corner of tab 58 and linear portion 54. A short cut line 61 formed in second side panel 18 extends in a longitudinal direction from linear portion 54.

Figure 3:
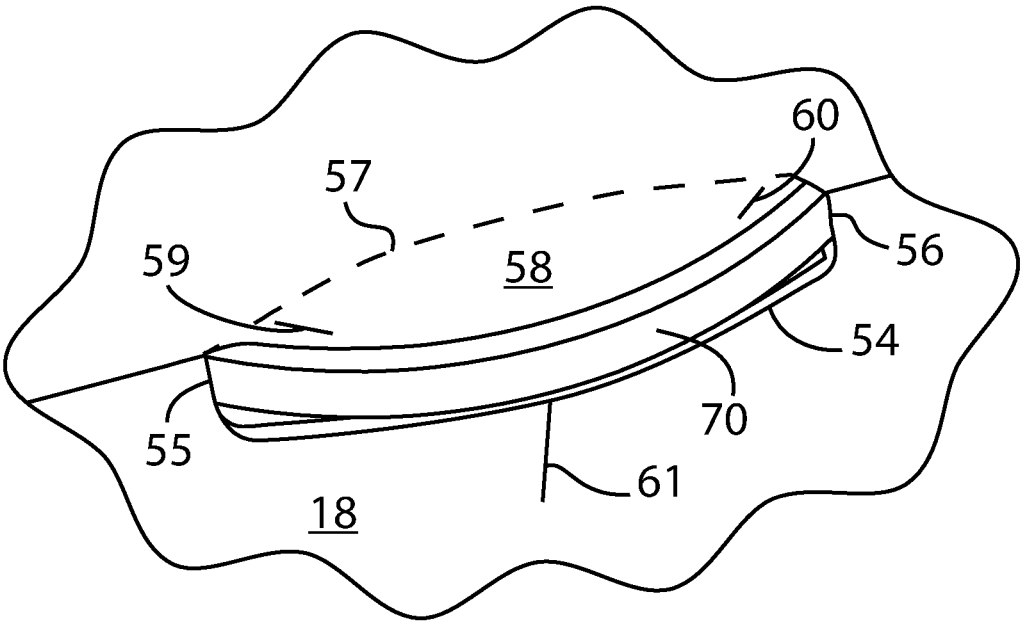
FIG. 3 is a close-up view showing a chime locker of the carton of FIG. 2 engaging a bottom chime of a corresponding article.

FIG. 3 shows a close-up view of a chime lock 50 in the constructed carrier 90, engaging a chime 70 of an article C. An outer portion of the chime 70 projects out through the aperture of chime lock 50 formed when chime retaining tab 58 is folded out of plane with the remainder of the side panel. Chime retaining tab 58 is seated within the recessed base of article C. Chime retaining tab 58 is sized so as to substantially follow the contour of the portion of the inner face of the cup chime 70 present within the aperture of chime lock 50, thereby locking the cup chime 70 in the aperture. Fold lines 59 and 60 facilitate this contouring of chime retaining tab 58. Cut line 61 facilitates contouring of the side panel about the body of the article C.

Turning to the construction of the carrier 90 as shown in FIG. 2, the carrier 90 can be formed by a series of sequential folding operations. The assembly process is not limited to that described below and may be altered according to particular manufacturing requirements.

Figure 4A:
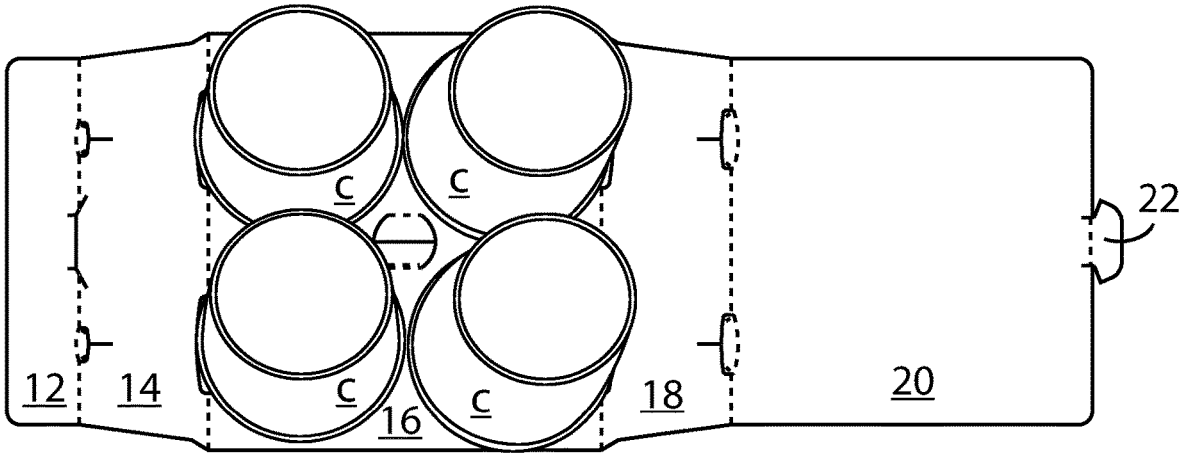
FIGS. 4A-4E show various steps in the construction of the carton of FIG. 2.
Figure 4B:
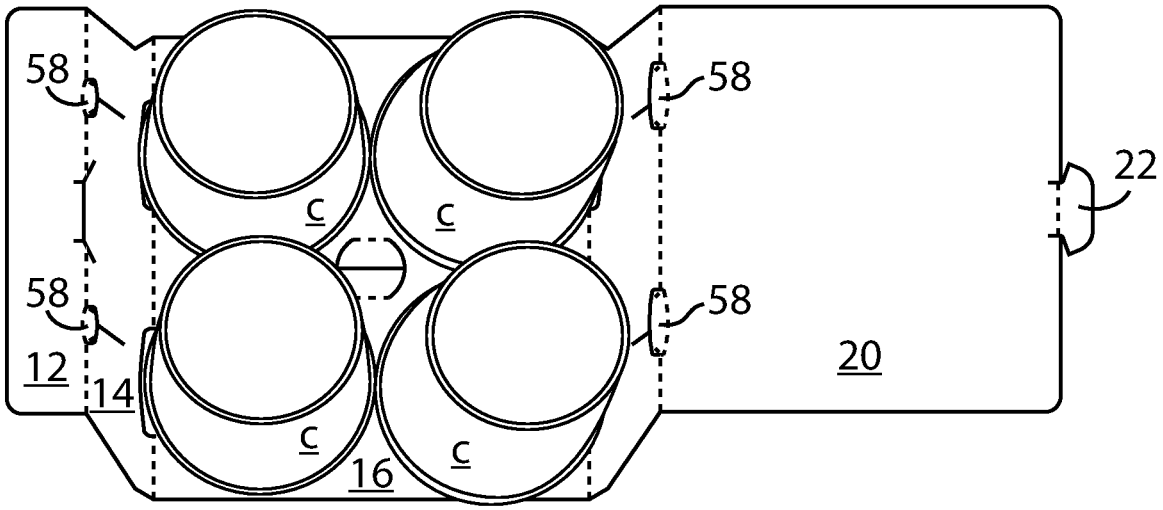
Figure 4C:
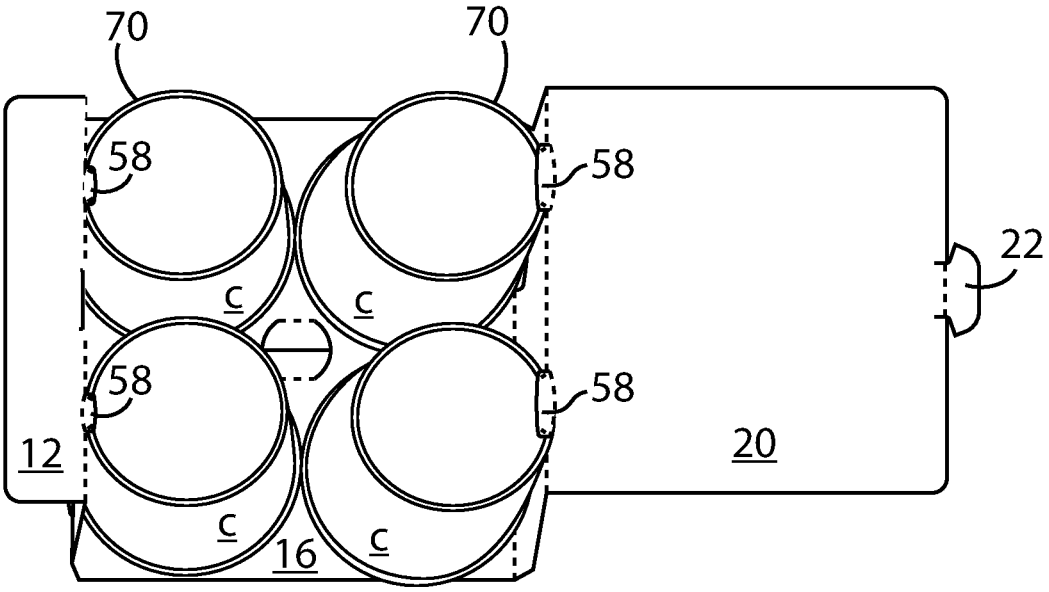
Figure 4D:
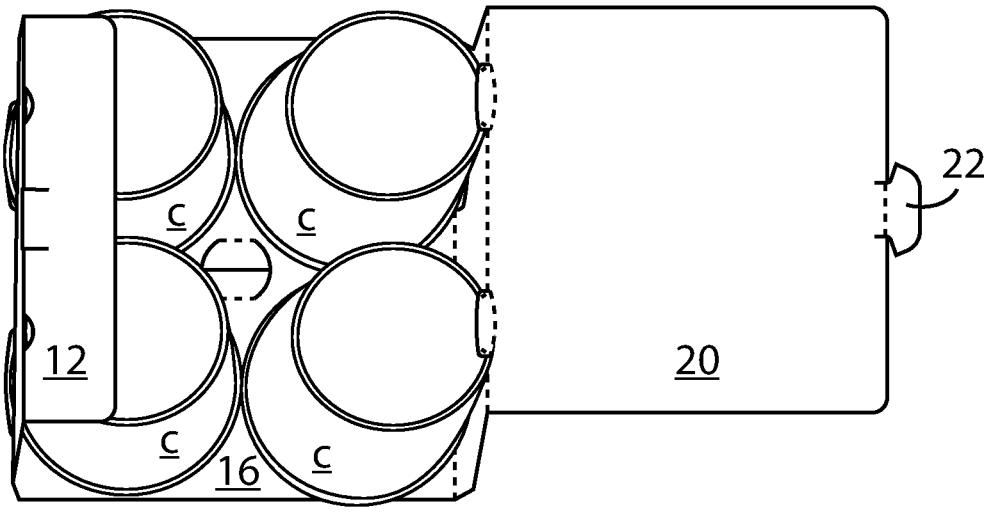
Figure 4E:
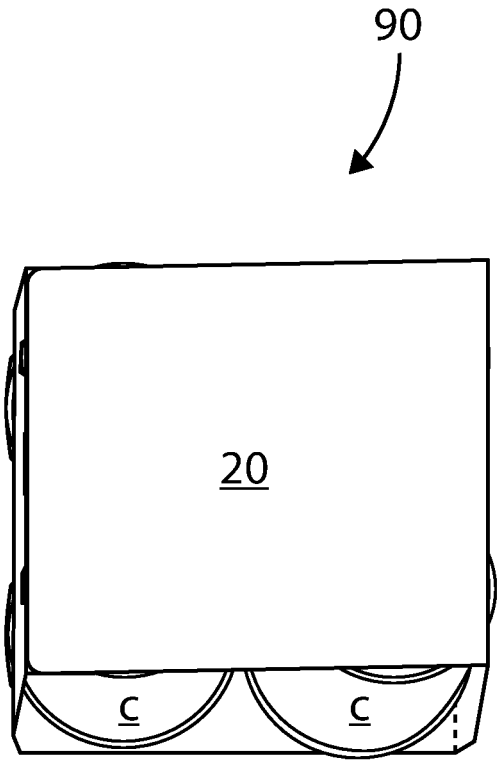

As shown in FIG. 4A, blank 10 is positioned with its interior surface facing up. Articles C are positioned top down over the interior surface of top panel 16 so that an outermost edge of their respective top lids is aligned with a corresponding top flange engaging slot 43. As shown in FIG. 4B, blank 10 is then folded inwardly about fold lines 15, 17 and outwardly about fold lines 13, 19. The outward folding of blank 10 about fold lines 13, 19 causes the free edges of chime retaining tabs 58 of chime locks 50, 52 to break away from the adjacent edges of respective chime retaining apertures. As shown in FIG. 4C, this enables each of the chime retaining tabs 58 to be positioned over a corresponding cup chime 70 as the first and second side panels 14, 18 are brought into contact with the articles' side walls via continued folding of blank 10 about fold lines 15, 17. As shown in FIG. 4D, secondary bottom panel 12 is then folded inwardly about fold line 13, bringing secondary bottom panel 12 into contact with the bottom surfaces of a first row of articles C. This also causes chime retaining tabs 58 of chime locks 52 to fold down into the recessed bases of their corresponding articles C so as to engage the inner surfaces of corresponding cup chimes 70. Primary bottom panel 20 is then folded inwardly about fold line 19 bringing primary bottom panel 20 into contact with the bottom surfaces of the articles C. This also causes chime retaining tabs of chime locks 50 to fold down into the recessed bases of their corresponding articles C so as to engage the inner surfaces of corresponding cup chimes 70. Male locking projection 22 is folded inwardly about fold line 21 and inserted into female locking opening 30. This results in the fully-constructed carrier 90 as shown in FIG. 4E.

Advantageously the combination of the corner lock (male locking projection 22 and female locking opening 30) with a full-size bottom panel (primary bottom panel 20) and chime locks 50, 52 permits the carrier 90 to securely retain two rows of tapered articles without the use of a central keel or spacer between the two adjacent rows of articles. In alternative embodiments, a pair of glued or corner-locked bottom lap panels may be used in place of primary and secondary bottom panels 20, 12.

Figure 5:
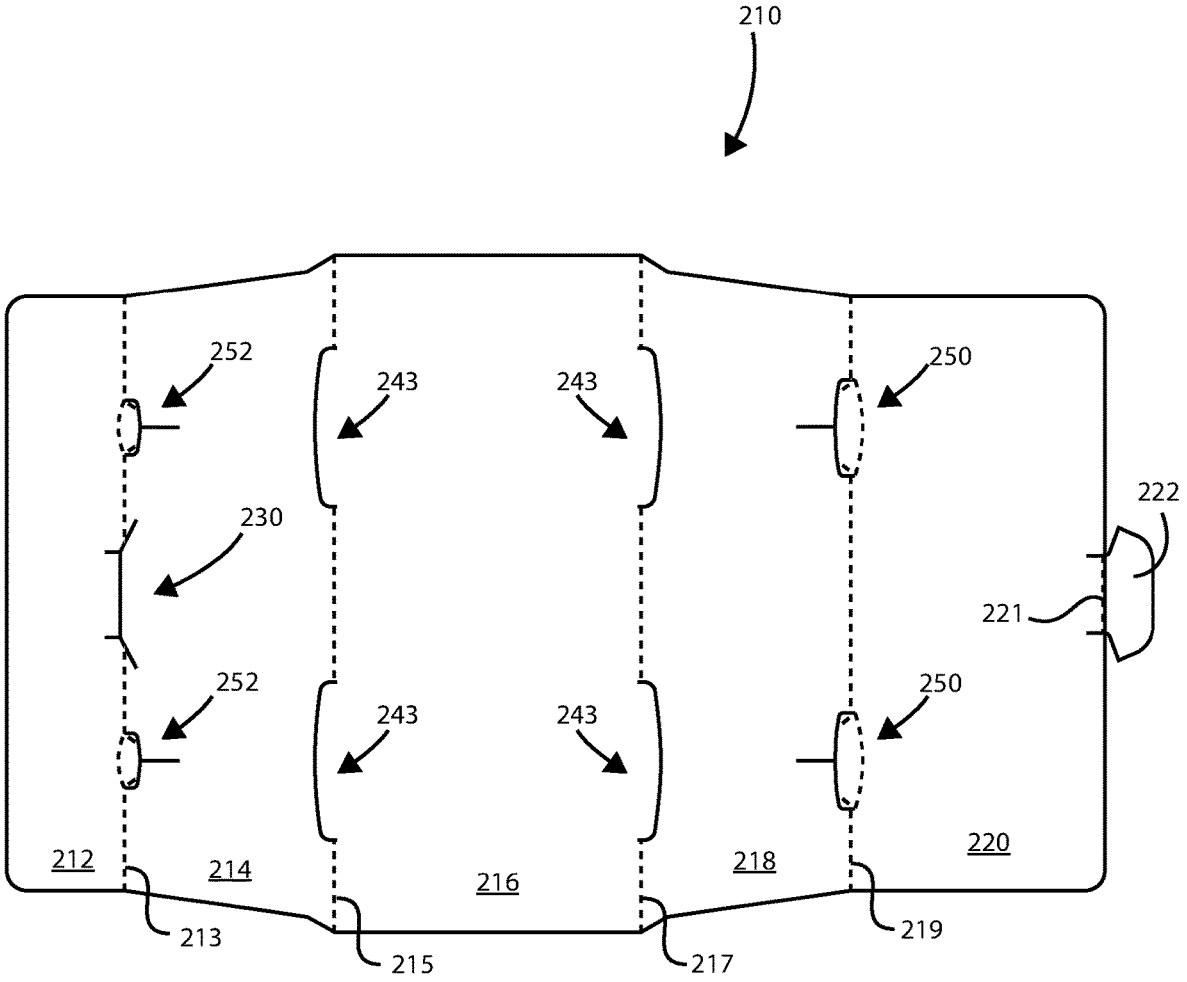
FIG. 5 is a plan view of a blank for forming a carton according to a second embodiment of the invention.
Figure 6:
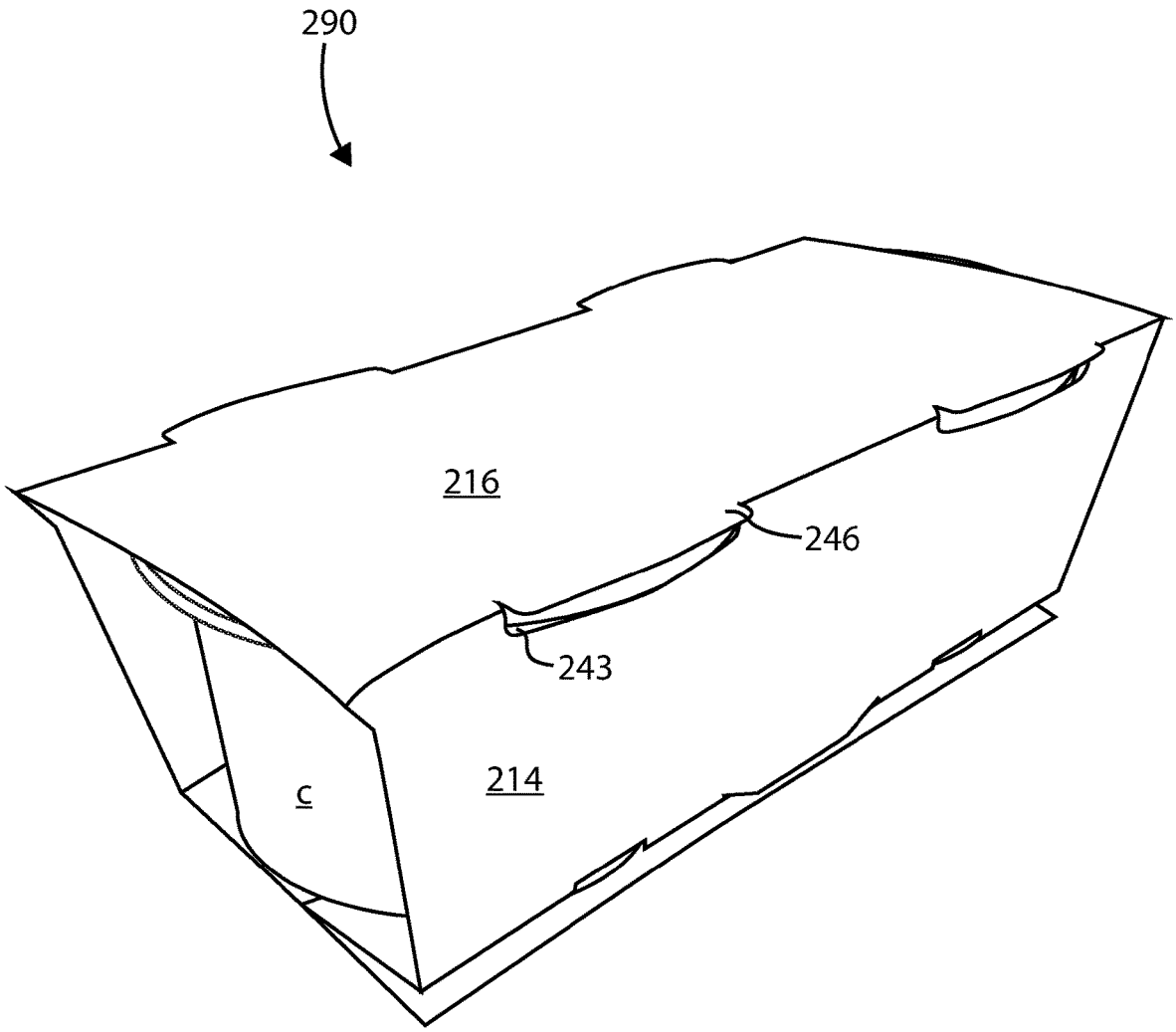
FIG. 6 is a perspective view of the carton formed from the blank of FIG. 5.

FIG. 5 is a plan view of a blank 210 used to form a carrier 290 (see FIG. 6) according to a second embodiment of the invention. Blank 210 and corresponding carrier 90 can be generally similar to the blank 10 and carrier 90 discussed above, and like or similar reference numbers in the figures indicate like or similar elements. The primary difference between the first and second embodiments is that the second embodiment is configured to accommodate a single row of two articles C.

It can be appreciated that various changes may be made within the scope of the present invention. For example, the size and shape of the panels may be adjusted to accommodate articles of differing size or shape.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and chime lock apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the terms "weakened line of severance", "severance line" and "frangible line" each may refer to all manner of lines formed in the blank or substrate of sheet material that facilitate separating portions of the blank or substrate of sheet material from one another, or otherwise that indicate optimal separation locations on the blank or substrate. As used herein, the terms "weakened line of severance", "severance line" and "frangible line" each may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines, weakened lines of severance, frangible lines and severance lines can each includes elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a frangible line. The line of perforations can be designed to facilitate folding and resist breaking to provide a fold line, to facilitate folding and facilitate breaking with more effort to provide a frangible fold line, or to facilitate breaking with little effort to provide a frangible line.

The invention claimed is:

1. A package comprising:

a plurality of articles arranged in a two-row group, each of the plurality of articles comprising a tapered body and a peripheral chime defining a recessed bottom; and a wraparound carrier enclosing said plurality of articles, the wraparound carrier comprising a plurality of chime locks, each of the plurality of chime locks engaging the peripheral chime of a corresponding one of the plurality of articles, wherein a bottom wall of said wraparound carrier is formed from a primary bottom panel, said primary bottom panel having a width equal to a width of the bottom wall defined between opposing first and second side panels of the wraparound carrier, wherein said wraparound carrier further comprises a secondary bottom panel, wherein said primary bottom panel and said secondary bottom panel are secured together via a corner lock, wherein said corner lock comprises a male locking projection hingedly connected to said primary bottom panel and a female locking opening formed at or adjacent to a fold line between said secondary bottom panel and the first side panel, wherein said plurality of chime locks comprises a first pair of chime locks disposed at or adjacent to the fold line between said secondary bottom panel and the first side panel, wherein said female locking opening is disposed between said first pair of chime locks, said plurality of chime locks further comprising a second pair of chime locks disposed at or adjacent to a fold line between said primary bottom panel and the second side panel, wherein said first pair of chime locks is smaller in size than said second pair of chime locks.

2. The package of claim 1, wherein each of the plurality of chime locks comprises a retaining aperture in which the peripheral chime of the corresponding one of the plurality of articles is received, and a retaining tab that sits within the recessed bottom of the corresponding one of the plurality of articles, wherein the retaining aperture is formed in a side wall of the wraparound carrier when the retaining tab is folded out of plane with a remaining portion of said side wall.

3. The package of claim 2, wherein said retaining tab is hinged along an arcuate fold line extending between opposite ends of the retaining aperture.

4. The package of claim 1, wherein each of the plurality of articles further comprises a flanged top, and wherein the wraparound carrier further comprises a plurality of flange engaging slots, each of the plurality of flange engaging slots engaging the flanged top of a corresponding one of the plurality of articles.

5. A package comprising a wraparound carrier enclosing a plurality of articles arranged in at least a one-row group, each of the plurality of articles comprising a substantially cylindrical body and a peripheral chime defining a recessed bottom, the wraparound carrier comprising:

a top panel;

a pair of first and second side panels;

a primary bottom panel and a secondary bottom panel hingedly connected to the second and first side panels respectively; and a plurality of chime locks, each of the chime locks comprising a retaining aperture for receiving part of the peripheral chime of a corresponding one of the plurality of articles and a retaining tab for placement within the recessed bottom of the corresponding one of the plurality of articles;

wherein a bottom wall of said wraparound carrier is formed from the primary bottom panel, said primary bottom panel having a width equal to a width of the bottom wall defined between said first and second side panels, wherein said primary bottom panel and said secondary bottom panel are secured together via a corner lock, wherein said corner lock comprises a male locking projection hingedly connected to said primary bottom panel and a female locking opening formed at or adjacent to a fold line between said secondary bottom panel and the first side panel, wherein said plurality of chime locks comprises a first pair of chime locks disposed at or adjacent to the fold line between said secondary bottom panel and the first side panel, wherein said female locking opening is disposed between said first pair of chime locks, said plurality of chime locks further comprising a second pair of chime locks disposed at or adjacent to a fold line between said primary bottom panel and the second side panel, wherein said first pair of chime locks is smaller in size than said second pair of chime locks.

6. The package of claim 5, wherein said retaining tab is hinged to a respective one of the primary bottom panel and secondary bottom panel along an arcuate fold line.

7. The package of claim 5, wherein each of the plurality of articles further comprises a flanged top, and wherein the wraparound carrier further comprises a plurality of flange engaging slots for engaging part of a flanged top of a corresponding one of the plurality of articles, the flange engaging slots being defined in a respective one of the first and second side panels.

* * * * *